US005233792A

United States Patent [19]

Suzuki

[11] Patent Number: 5,233,792

[45] Date of Patent: Aug. 10, 1993

[54] APPARATUS FOR SUPERFINISHING CUTTING EDGES

[75] Inventor: Hiromi Suzuki, Ohbu, Japan

[73] Assignee: Kabushiki Kaisha Taihei Seisakusho, Komaki, Japan

[21] Appl. No.: 772,427

[22] Filed: Oct. 7, 1991

[30] Foreign Application Priority Data

Nov. 26, 1990 [JP] Japan ..... 2-324928

[51] Int. Cl.[5] ..... B24B 3/38

[52] U.S. Cl. ..... 51/56 R; 51/111 R; 51/165.9

[58] Field of Search ..... 51/56 R, 109 BS, 111 R, 51/125, 165.71, 165.9, 283 E, 285

[56] References Cited

U.S. PATENT DOCUMENTS

| | | | |
|---|---|---|---|
| 1,199,672 | 9/1916 | Dick | 51/56 R |
| 1,980,872 | 11/1934 | Moul | 51/56 R |
| 2,539,107 | 1/1951 | Sectish | 51/56 R |
| 2,578,789 | 12/1951 | Donnelly | 51/217 R |
| 4,313,283 | 2/1982 | Smith | 51/56 R |
| 4,532,735 | 8/1985 | Dahlgren et al. | 51/56 R |
| 4,845,900 | 7/1989 | Suzuki et al. | 51/285 |
| 4,984,394 | 1/1991 | Suzuki | 51/109 BS X |

FOREIGN PATENT DOCUMENTS

| | | |
|---|---|---|
| 2224459 | 5/1972 | Fed. Rep. of Germany . |
| 2753289 | 5/1979 | Fed. Rep. of Germany . |

*Primary Examiner*—Bruce M. Kisliuk
*Assistant Examiner*—John A. Marlott
*Attorney, Agent, or Firm*—Lahive & Cockfield

[57] ABSTRACT

The invention provides an improved apparatus for grinding longitudinal ends of the cutting edge to a desired degree of superfine finish as a grinding wheel reciprocates between the ends. The apparatus applies a relatively constant pressure to the grinding wheel, thus allowing stable and desirable grind.

17 Claims, 14 Drawing Sheets

APPARATUS FOR SUPERFINISHING CUTTING EDGES

BACKGROUND OF THE INVENTION

The present invention relates to an apparatus for superfinishing true edges of cutting tools such as veneer lathes and veneer slicers, which have roughly been ground with a knife grinder.

Manual grinding with a flat grindstone is a traditional way for superfinishing the cutting edges of such tools. The manual grinding requires, however, skilled or experienced workers, and moreover, is both time- and labor-consuming.

Now machine superfinishing is conventionally carried out instead of the manual grinding, which employs spring elasticity or fluid pressure applied from a fluid cylinder to press a grinding wheel against the cutting edge. In this machine grinding, however, the dead weight of the grinding wheel is added to or subtracted from the applied pressure, that is, varies the pressure. The changeable pressure imparts vibrations to the grinding wheel as the wheel travels in the longitudinal direction of the cutting edge and may do damage to the cutting edge.

An example of the machine finishing is disclosed in JAPANESE PATENT PUBLICATION GAZETTE No. Sho-63-36903 under the title of 'Method and apparatus for superfinishing cutting edges' by the Inventors. The apparatus disclosed therein temporarily releases fluid pressure, which is applied to a grinding wheel to press the cutting edge, when the grinding wheel is detected to reach an longitudinal end of the cutting edge, thus allowing the grinding wheel to make a desirable number of reciprocating motions. The fluid pressure temporarily released is again applied to the grinding wheel when the grinding wheel starts moving back in the longitudinal direction of the cutting edge. At that time, the resultant vector of a force for transferring the grinding wheel parallel to the longitudinal direction of the cutting edge and a downward force for pressing the grinding wheel onto the cutting edge is applied to the grinding wheel. Accordingly, the grinding wheel is obliquely transported and pressed on the end of the cutting edge. The bias motion of the grinding wheel may fail to grind the end of the cutting edge to a desired degree of superfine finish.

As described above, no prior art sufficiently or desirably superfinishes the cutting edge which has been roughly ground.

SUMMARY OF THE INVENTION

An objective of the invention is thus to provide an improved apparatus for superfinishing the true edge of a cutting tool.

Another objective of the invention is to provide an apparatus for grinding longitudinal ends of the cutting edge to a desired degree of superfine finish as a grinding wheel reciprocates between the ends.

A further objective of the invention is to provide an apparatus which applies substantially constant pressure to a grinding wheel, thus preventing unstable or undesirable grinding.

A still further objective of the invention is to provide an apparatus which efficiently prevents rough surface or deformation of a grinding wheel due to superfine grinding.

The above and other related objectives are realized by an apparatus which includes: a table for supporting the cutting tool; a carriage movable in the longitudinal direction of the true edge of the cutting tool by a driving mechanism; a baseplate fixed to the carriage and leaning to the table; a transport unit mounted on the baseplate and movable to the cutting tool; a grinding wheel rotatably supported on the transport unit via slide means comprising a sliding body and a slide guide; pressing means engaged with the slide means for pressing the transport unit onto the cutting tool; a grind degree controller installed in between the baseplate and the transport unit for determining a grind degree; and a braking mechanism attached to the sliding body for pressing the slide guide and thereby locking the sliding movement of the sliding body.

The apparatus may further include: a rail laid above and parallel to the slide means against the grinding wheel; a movable balancer suspended from the rail; and a link support projected from the transport unit to the grinding wheel for connecting the slide means with the balancer.

The apparatus may also include a dresser bar having an outer grinding face, which is detachably mounted on a desired position of the longitudinal length or its extension of the table so as to be parallel to the true edge of the cutting tool.

The baseplate is leaned to the cutting tool fixed on the table so as to determine a desirable cutting angle. The transport unit is then pressed towards the cutting tool by the pressing means while the slide means engaged with the pressing means moves towards the cutting tool. Accordingly, the grinding wheel is pressed against the true edge of the cutting tool. After the initial grind degree of the true edge is determined by the grind controller, the grinding wheel pressed against the true edge starts rotation and the carriage is actuated by the driving mechanism; namely, the grinding wheel starts grinding the true edge. When the grinding wheel reaches the longitudinal end of the true edge, the braking mechanism presses the slide guides to lock the sliding body. The oblique motion to the end of the cutting edge due to the resultant vector described above is effectively prevented, and the cutting edge is ground to a desired degree of superfine finish.

The grinding wheel and the slide means are slidable due to the dead weights thereof during grinding operation. The balancer suspended from the rail, however, moves along the rail in a direction to balance the dead weights and prevents undesirable sliding, thus allowing stable grind.

When the apparatus includes the dresser bar mounted on a desired desirable position of the longitudinal length of the table, the grinding wheel is transported and pressed to the dresser bar. Rotation of the grinding wheel and movement of the carriage by the driving mechanism make the grinding wheel polished to a desirable degree, thus preventing unstable grind of the true edge.

BRIEF DESCRIPTION OF THE DRAWINGS

The invention may be best understood by referring to the following detailed description of the preferred embodiments and the accompanying drawings, wherein like numerals denote like elements and in which.

DESCRIPTION OF THE PREFERRED EMBODIMENTS

Figure 1:
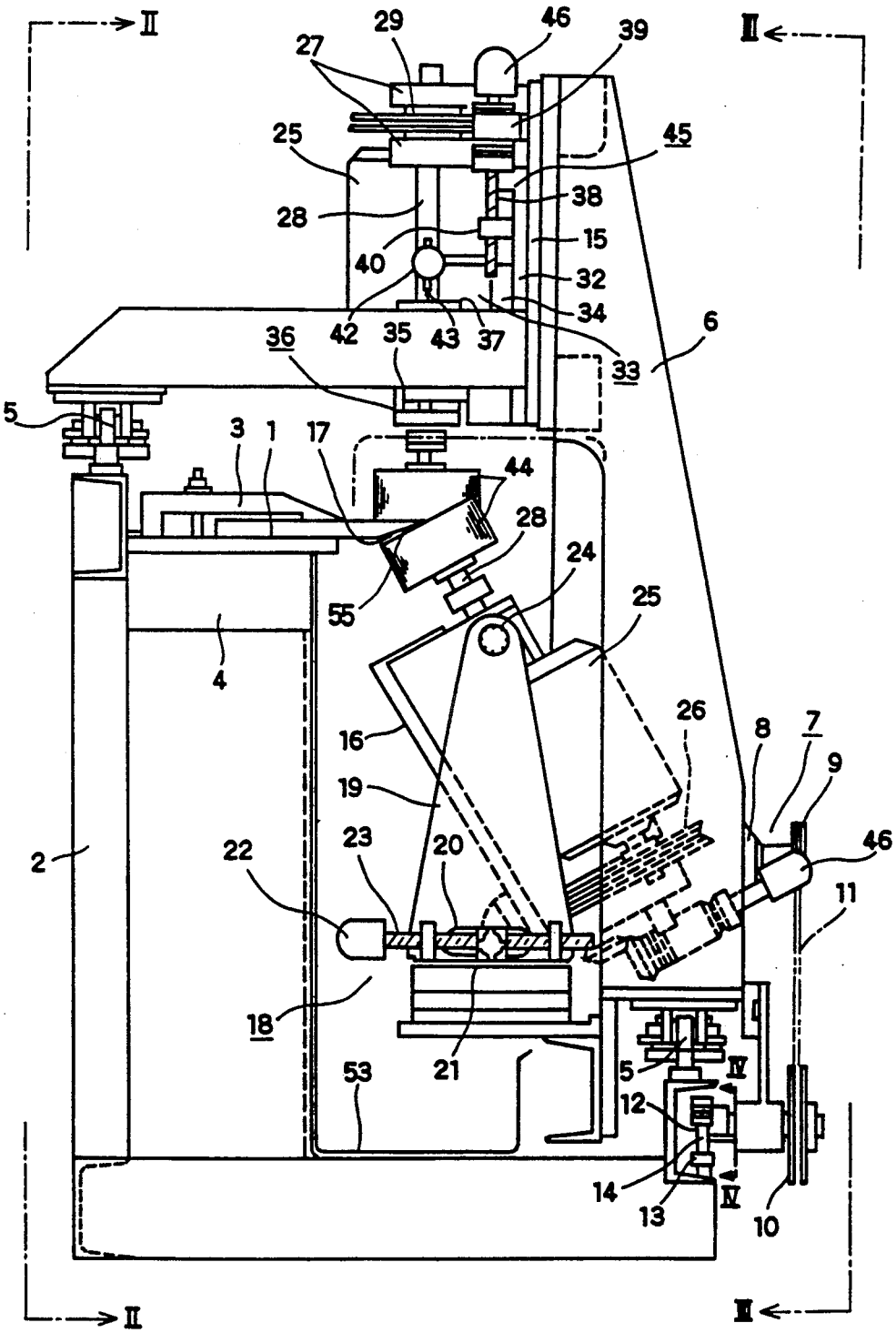
FIG. 1 is a side view illustrating a superfinishing apparatus of a first embodiment according to the invention.
Figure 2:
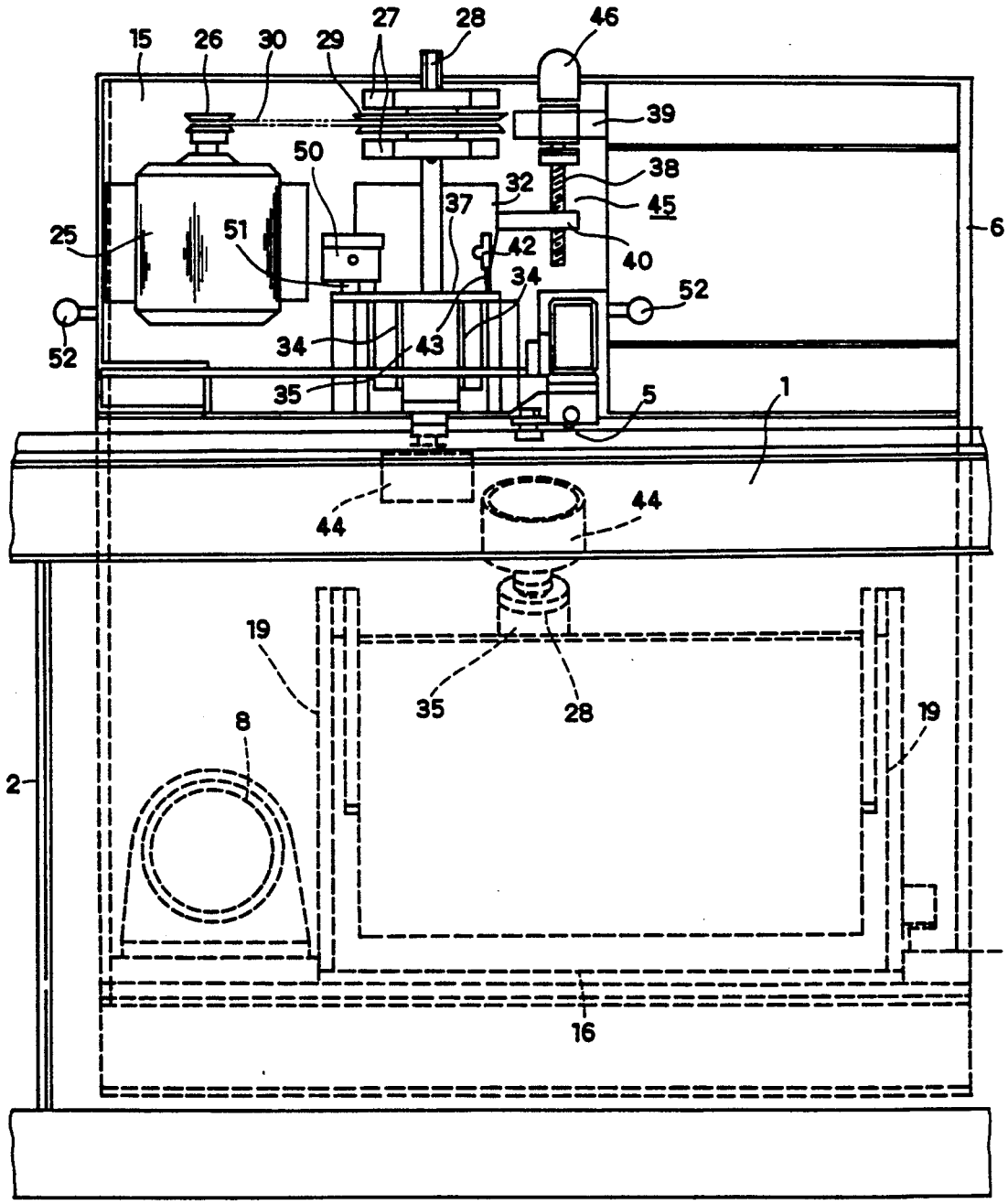
FIG. 2 is a rear view illustrating the apparatus of FIG. 1, seen from the line II—II.
Figure 3:
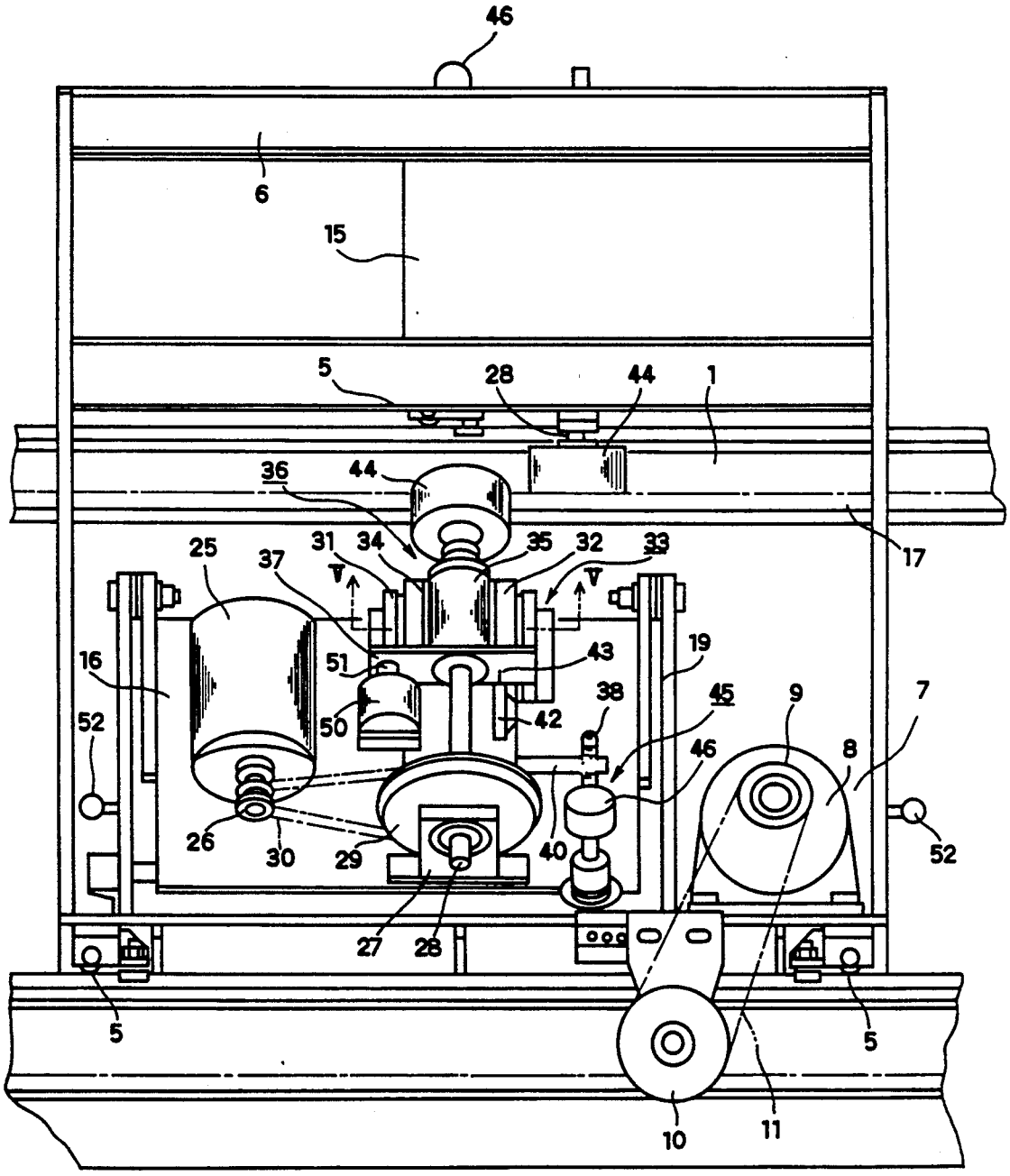
FIG. 3 is a front view illustrating the apparatus of FIG. 1, seen from the line III—III.

An apparatus for superfinishing a cutting edge of a first embodiment according to the invention is described in detail based on FIGS. 1 through 5.

A cutting tool 1 is fixed by a fixing unit 3 onto a table 4 which is disposed adjacent to an upright panel 2 having a length equal to or greater than the length of the cutting tool 1.

Figure 4:
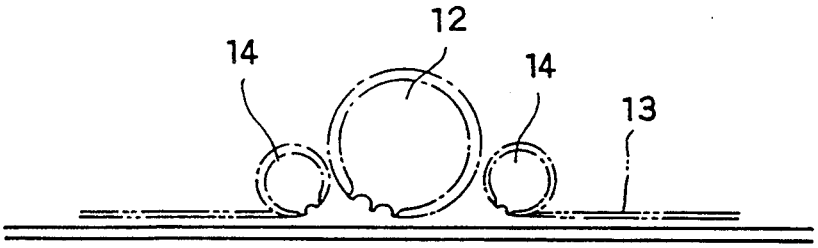
FIG. 4 is an enlarged view illustrating an arrangement of a chain and a pulley, seen from the line IV—IV of FIG. 1.
Figure 5:
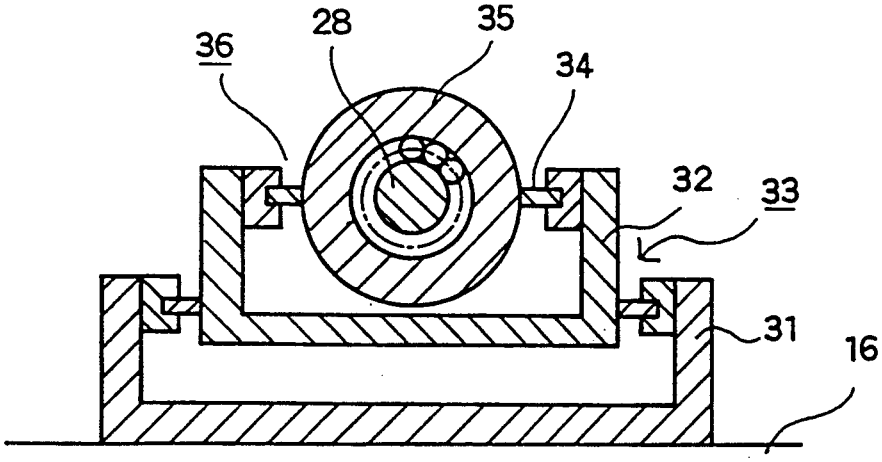
FIG. 5 is a cross sectional view taken on the line V—V of FIG. 3.

A carriage 6 with rollers on the four corners thereof is mounted on the upright panel 2 and has a driving mechanism 7. The driving mechanism 7 for moving the carriage 6 includes: a prime mover 8 mounted on the lower portion of the carriage 6; a belt 11 runs between a pulley 9 of the prime mover 8 and another pulley 10 attached below the pulley 9; a chain pulley 12 connected to the pulley 10; and a chain 13 supported in tension to the longitudinal ends of the upright panel 2 with springs (not shown). A pair of support chain pulleys 14 mounted adjacent to the chain pulley 12 as shown in FIG. 4 are engaged with the chain 13 so as to prevent vibration of the chain pulley 12.

An upper and a lower baseplates 15 and 16 are attached to the carriage 6 in such a manner that they face the cutting tool fixed on the table 4 and are placed at different longitudinal positions.

The cutting tool 1 is fixed with a true edge 17 facing downward. An angle controller 18 is attached to the lower baseplate 16 so as to move the baseplate 16 along the slope of the true edge 17.

The angle controller 18 includes a pair of support plates 19 disposed on both the sides of the lower baseplate 16 for supporting the leaned baseplate 16. One end of a guide shaft 21 projected from the baseplate 16 is inserted into an opening 20 formed on the lower portion of the support plate 19 and the other end thereof is engaged with a worm shaft 23 connected to a motor 22. The leaning angle of the baseplate is adjusted by the worm shaft 23 and is detected by a rotational angle detector 24 including an encoder and a linear transformer.

The baseplates 15 and 16 are provided with a prime mover 25, respectively. A belt 30 runs between a pulley 26 of the prime mover 25 and another pulley 29 slidable to a drive shaft 28 supported between a pair of bearings 27.

A transport unit 33 includes: a pair of guide plates 31 spaced from each other by a predetermined distance and installed in the middle of the baseplates 15 and 16; and a transport member 32 movable to the cutting tool 1 and supported between the guide plates 31. A slide unit 36 includes a pair of slide guides 34 attached to the transport member 32 and a sliding body 35. The transport unit 33 and the slide unit 36 are slidable to each other. In the embodiment, the tubular sliding body 35 with the drive shaft 8 securely fitted therein is fixed to the slide guides 34 and a control plate 37 is further attached to the rear portion of the sliding body 35.

A grind degree controller 45 includes: a feed shaft 38; and a bearing 39 attached to the baseplate 15 or 16 for supporting the feed shaft 38. The feed shaft 38 is inserted in an arm 40 projected from an end of the transport table 32. A dial indicator 42 with contacts for setting plural preset distances is further mounted on the transport table 32. The end of a spindle 43 is pressed against the control plate 37, thereby determining the travel distance of the transport table 32 or the degree of grind of the cutting tool 1 by a grinding wheel 44 supported on the end of the drive shaft 28.

The grind degree controller 45 drives a motor 46 directly connected to the feed shaft 38 and stops the motor 46 when an indication of the dial indicator 42 is ensured to reach the preset distance by a proximity switch (not shown). An encoder or a linear transformer may be used instead of the dial indicator 42.

A pair of detectors 52 are attached to both the ends of the carriage 6 and each includes a limit switch, a photoelectric tube and a proximity switch. A cooling water groove 53 spans the whole moving distance of the grinding wheel 44 between the upright panel 2 and the able 4.

Figure 6:
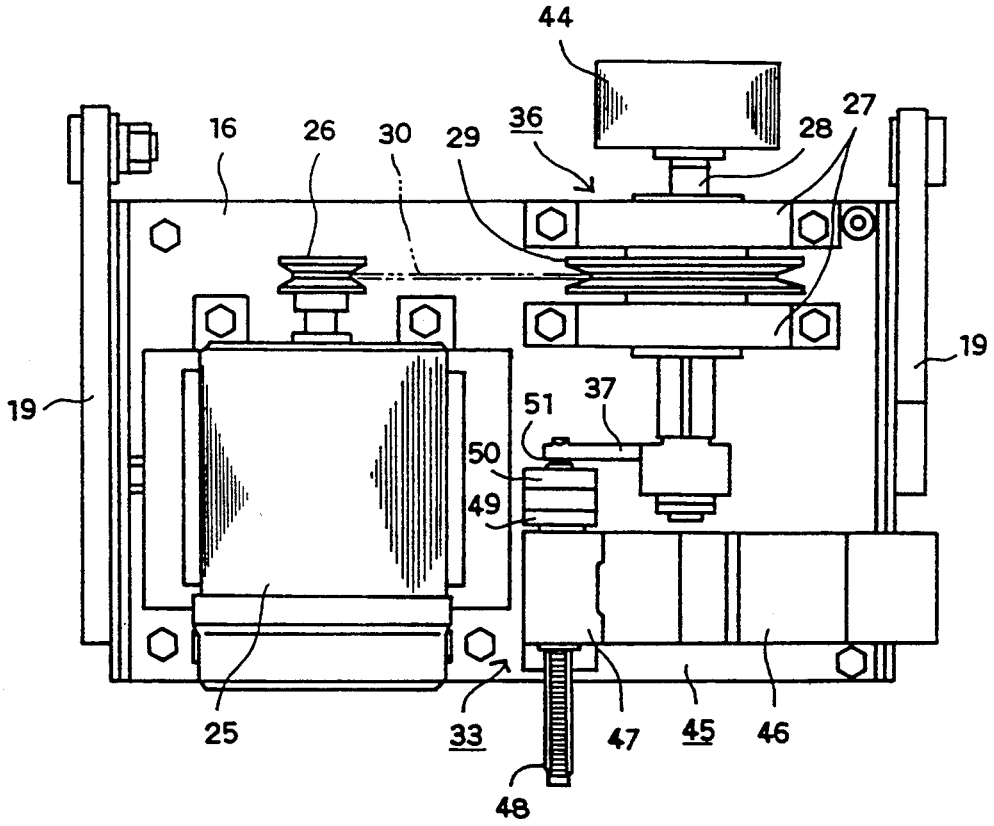
FIG. 6 is an enlarged view illustrating part of an apparatus as modification of the first embodiment.
Figure 7:
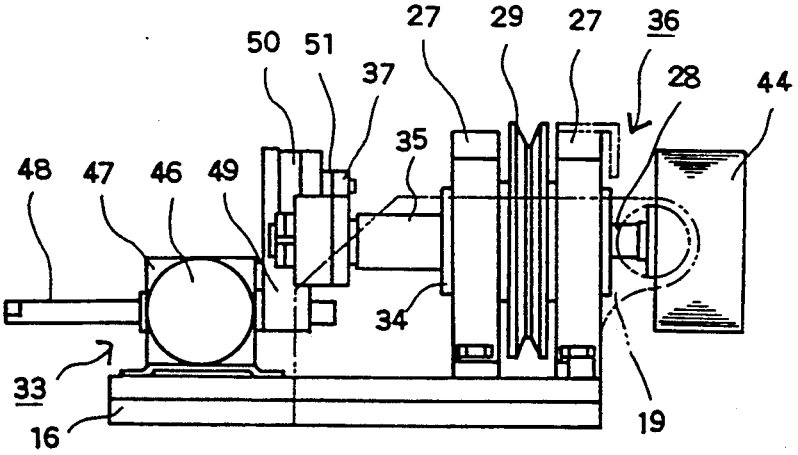
FIG. 7 is a side view illustrating the apparatus of FIG. 6.

FIGS. 6 and 7 show modification of the first embodiment. The modified embodiment is similar to the first embodiment except some parts described below.

The transport unit 33 on the baseplate 15 or 16 includes: a rack 48 fitted in a bearing 47 mounted on the baseplate 15 or 16; and a bracket 49 attached to the end of the rack 48. The rack 48 of the transport unit 33 is movable to the true edge of the cutting tool 1 by the motor 46. The slide unit 36 supporting the grinding wheel 44 for grinding the cutting tool 1 includes the drive shaft 28 slidably supported in between the pair of bearings 27 mounted on the baseplate 15 or 16. A fluid cylinder 50 is attached to the upper end of the bracket 49, and a piston rod 51 of the cylinder 50 is connected to the control plate 37. The grind degree controller 45 activates the motor 46 for driving the rack 48 and stops the motor 46 when an indication of the dial indicator 42 is ensured to reach the preset distance by a proximity switch (not shown).

In the above embodiment, the transport unit 33 slidable to the cutting tool 1 and the slide unit 36 supporting the grinding wheel 44 for grinding the cutting tool 1 are controlled by making use of fluid pressure applied from the fluid cylinder 50 and the piston rod 51 thereof. Alternatively, a spring may be used for the same purpose.

Figure 8:
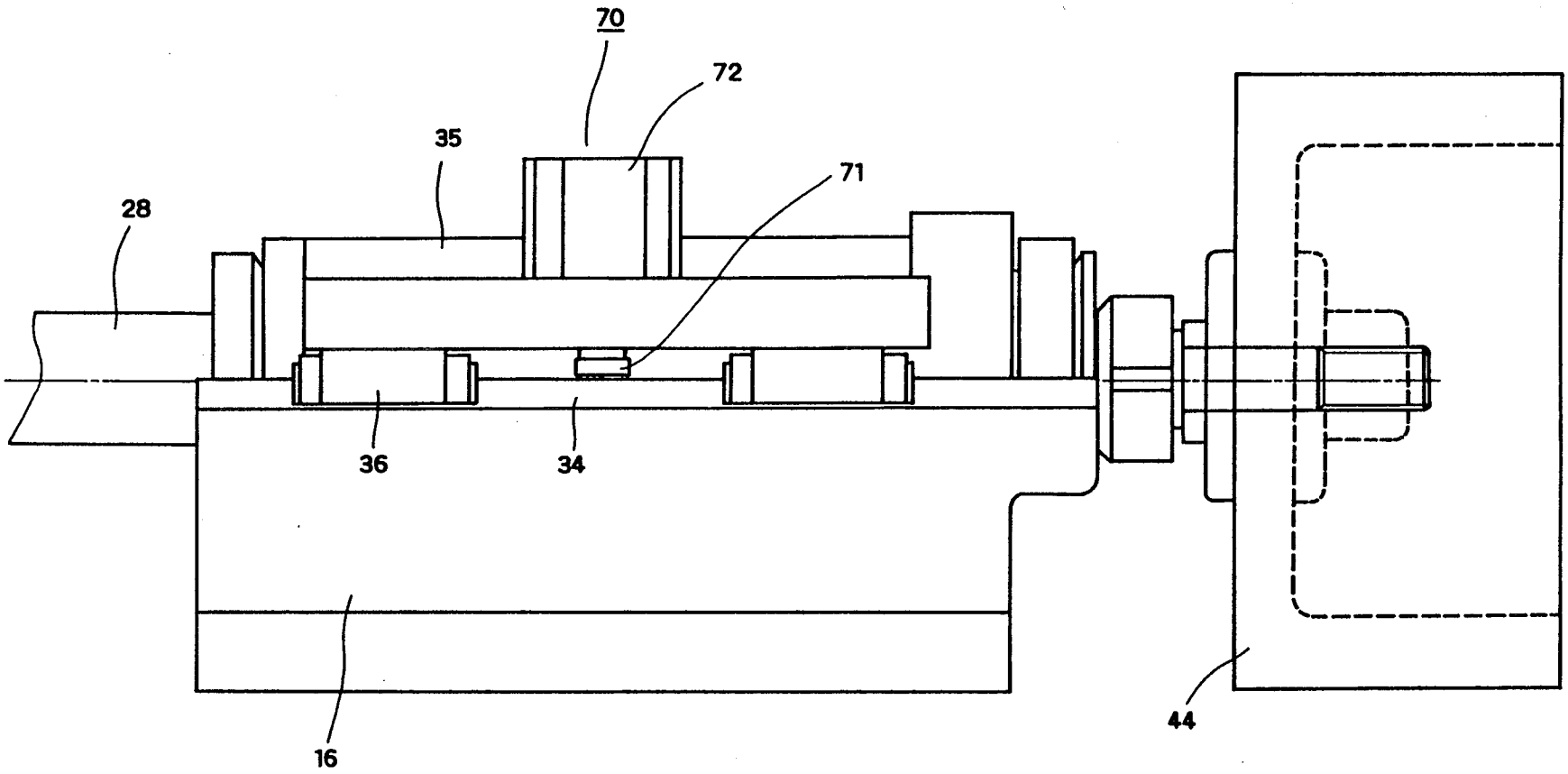
FIG. 8 is an enlarged side view illustrating part of the apparatus of the first embodiment or its modification.
Figure 9:
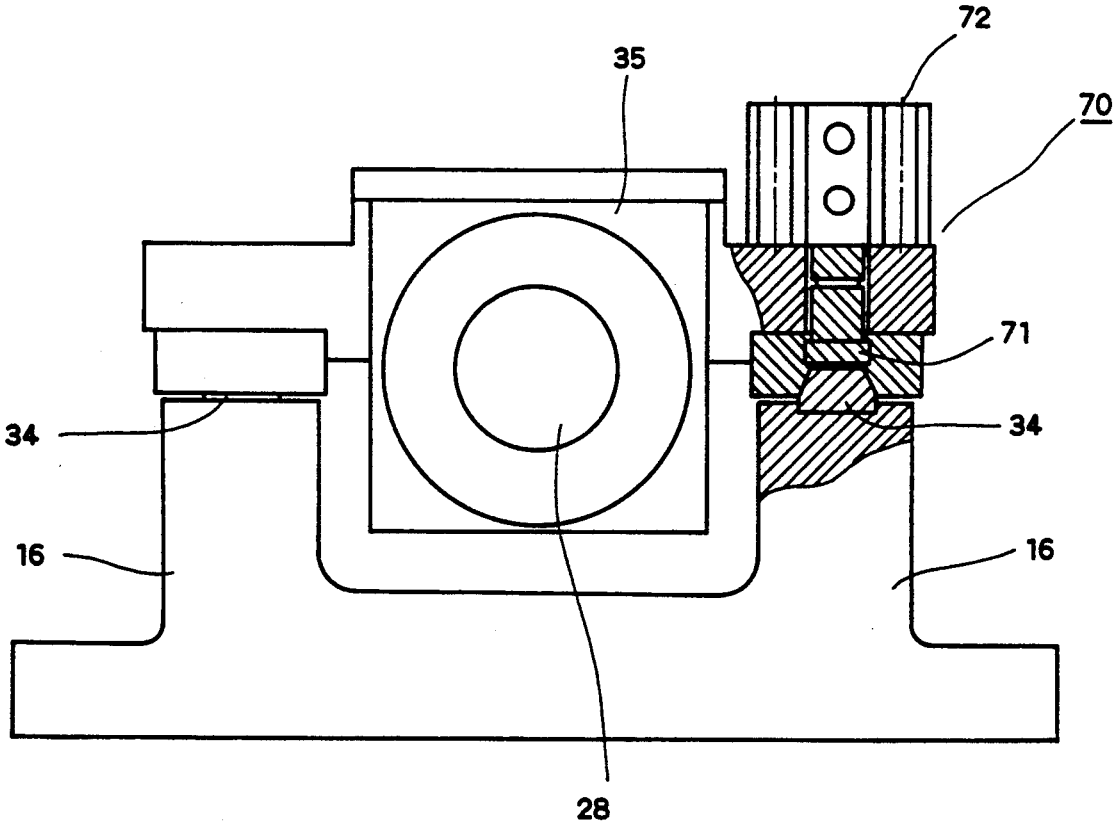
FIG. 9 is a partly broken front view illustrating the part of FIG. 8.

Both in the first embodiment and the modified embodiment, the slide unit 36 includes a braking mechanism as shown in FIGS. 8 and 9. The braking mechanism 70 includes: a piston rod 71 for pressing either of the slide guides 34 leading the sliding body 35; and a cylinder 72 for actuating the piston rod 71 by fluid pressure.

Although the embodiment employs fluid pressure to the braking mechanism, it may be any other mechanisms, for example, actuating a screw by a servo motor, or locking by a plunger corresponding to ON-OFF of an electromagnet. The number of the braking mechanism is not limited.

The apparatus for superfinishing the cutting edge thus constructed is operated in the following manner.

The cutting tool 1, which has roughly been ground with a knife grinder is horizontally (in the first embodiment) or vertically (in the modified embodiment) laid on the table 4 and fixed by the fixing unit 3.

The motor 22 is driven by a predetermined amount so as to activate the angle controller 18 to determine the grind angle of the lower (in the first embodiment) or left (in the modified embodiment) grinding wheel 44 to the true edge of the cutting tool 1. The grind angle is then detected by the rotational angle detector 24 and the driving mechanism 7 is actuated.

The initial grind degree of the true edge is determined by the grind degree controller 45. The prime mover 8 is driven and the carriage 6 is moved so as to transfer the grinding wheel 44 to the cutting tool 1. When the carriage reaches the cutting tool 1, the fluid cylinder 50 is actuated to supply fluid from each port thereof in such a manner that the pressure in a rear cylinder chamber of the cylinder 50 is higher than that of a front cylinder chamber of the cylinder 50 so as to stretch the piston rod 51. Accordingly, the transport unit 33 and the slide unit 36 are moved towards the true edge of the cutting tool 1 while the control plate 37 is pressed by the piston rod 51.

In the first embodiment, when the feed shaft 38 is rotated, the transport table 32 is guided along the guide plates 31 to move forward together with the sliding body 35. After the grinding wheel 44 is made contact with the true edge of the cutting tool 1, the sliding body 35 is moved back while the transport table 32 remains at the position. Rotation of the feed shaft 38 gives backward moment to the sliding body 35 and the transport table 32 even when the grinding wheel 44 is in contact with the true edge of the cutting tool 1. The grinding wheel 44 is, however, pressed forward by the piston rod 51 of the fluid cylinder 50 and remains in contact with the true edge while the sliding body 35 is moved back.

The magnitude of the backward moment is determined by adding an expected degree of unevenness in rough grind to the grind degree of a ricasso 55 with respect to the true edge. When the sliding body 35 is moved back by the preset amount of the dial indicator 42, the feed shaft 38 stops rotation.

In the modified embodiment shown in FIGS. 6 and 7, when the rack 48 is moved forward along the bearing 47, the piston rod 51 of the fluid cylinder 50 attached to the bracket 49 slides the drive shaft 28 via the control plate 37 so as to make the grinding wheel 44 contact with the true edge of the cutting tool 1. Backward moment is then applied to the drive shaft 28 as in the first embodiment. The fluid pressure pressing the drive shaft 28 forward is equal to the amount determined by adding an expected degree of unevenness in rough grind to the grind degree of a ricasso 55 with respect to the true edge.

The fluid is released from the rear cylinder chamber of the fluid cylinder 50 so as to contract the piston rod 51 and actuate the driving mechanism 7 to move the carriage 6 back to its original waiting position. The prime mover 25 is then actuated to apply a rotational force to the grinding wheel 44.

The chain pulley 12 starts rotation with actuation of the driving mechanism 7. Since the chain pulley 12 is supported by the support chain pulleys 14 mounted on both sides thereof to increase the running force to the chain 13, the carriage 6 smoothly moves and the grinding wheel 44 favorably starts grind of the cutting tool 1.

When the detector 52 detects that the carriage 6 reaches one longitudinal end of the cutting tool 1, the cylinder 72 of the braking mechanism 70 is actuated to make the piston rod 71 press the slide guides 34 and lock the sliding motion of the sliding body 35. Accordingly, the grinding wheel 44 moves straight along the true edge, thus preventing insufficient grind of the end of the true edge. Namely, the grinding wheel 44 moves straight along the true end of the cutting tool in the whole grinding process so as to grind the whole length of the true edge stably and constantly.

The carriage 6 is repeatedly moved along the cutting tool 1 while efficiently preventing burning of the true edge of the cutting tool 1. When completion of grind at the initial angle is determined by the value on a counter and the preset amount of the dial indicator 42, the driving mechanism 7 is temporarily stopped and the motor 22 is rotated by a predetermined amount so as to actuate the angle controller 18 to determine the next grind angle. The rotational angle detector 24 detects the grind angle and actuates the driving mechanism 7 again. Multi-stage grinding is performed by repeating the above process as appropriate.

Figure 10:
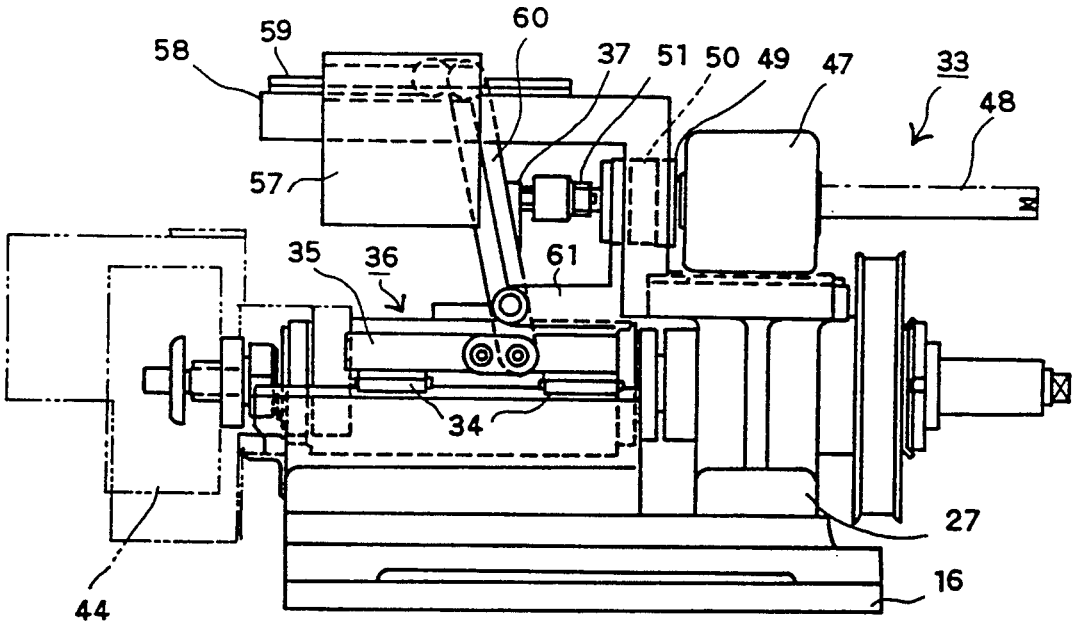
FIG. 10 is an enlarged side view illustrating part of an apparatus of a second embodiment according to the invention.
Figure 11:
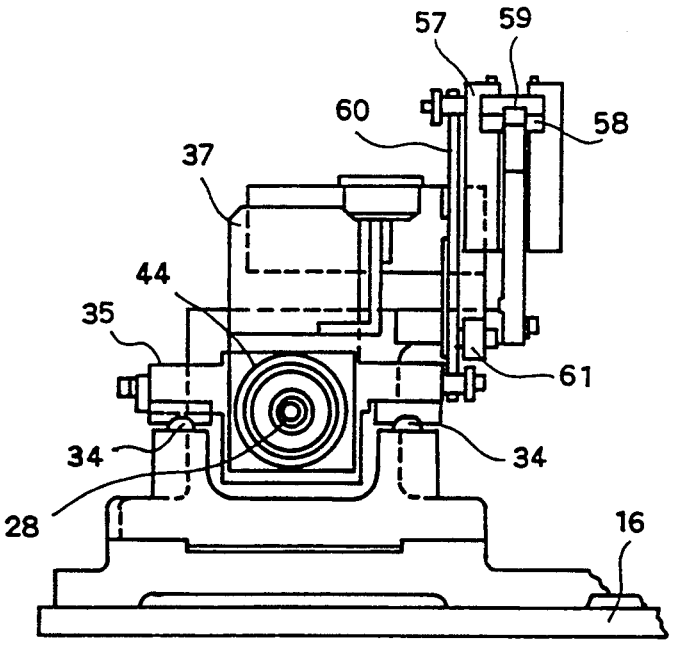
FIG. 11 is a front view showing the apparatus of FIG. 10.

A second embodiment of the invention is now described in detail according to FIGS. 10 and 11.

An apparatus of the second embodiment includes a balancer and its attendant parts besides the structure of the first embodiment. Since the second embodiment mostly has similar structure, operation, and effects to the first embodiment, only different points are described here.

A transport unit 33 includes: a bearing 47 for supporting a rack 48 attached above a bearing 27, which is mounted on the rear portion of the baseplate 15 or 16 for supporting a drive shaft 28; and a bracket 49 inserted in the rack 48. The rack 48 is movable to the true edge of the cutting tool 1 by a motor 46. A slide unit 36 includes: a fluid cylinder 50 attached to the bracket 49; and a piston rod 51 connected with a control panel 37. A sliding body 35, through which the drive shaft 28 is inserted, is supported by a pair of slide guides 34 installed on the front portion of the baseplate 15 or 16. The control plate 37 is connected to the upper portion of the sliding body 35.

A rail 58 is projected from the upper side end of the base plate 15 or 16 parallel to the sliding direction of the drive shaft 28. A slide member 59 such as a roller or a linear way is attached onto the rail 58, and a balancer 57 is suspended from the rail 58 via the slide member 59. The slide unit 36 and the balancer 57 are connected to each other by a link 60 with a fulcrum on the end of a link support 61 projected from the transport unit 33 towards the grinding wheel 44. The weight of the balancer 57 is determined by the length of the link 60 from the fulcrum of the link support 61.

The apparatus for superfinishing the cutting edge thus constructed is operated in the following manner.

When the rack 48 is moved forward along the bearing 47, the piston rod 51 of the fluid cylinder 50 attached to the bracket 49 slides the sliding body 35 with the drive shaft 28 therein via the control plate 37 so as to make the grinding wheel 44 contact with the true edge of the cutting tool 1. Although backward moment is applied to the drive shaft 28 at this moment, the driving wheel 44 remains in contact with the true edge because of forward pressure of the piston rod 51 of the fluid cylinder 50 against the drive shaft 28 as in the first and modified embodiments. The baseplate 15 or 16 is leaned here, and the dead weights of the grinding wheel 44 and the transport unit 33 are about to slide the slide unit 36. The balancer 57 on the rail 58 projected from the baseplate 15 or 16 moves along the rail 58 in a direction to balance the dead weights thereof with the fulcrum on the link support 61, thus allowing stable and constant grind.

The balancer 57 moves along the rail 58 to adjust the grind degree of the true edge of the cutting tool 1 each time when the angle controller 18 changes the grind angle.

Figure 12:
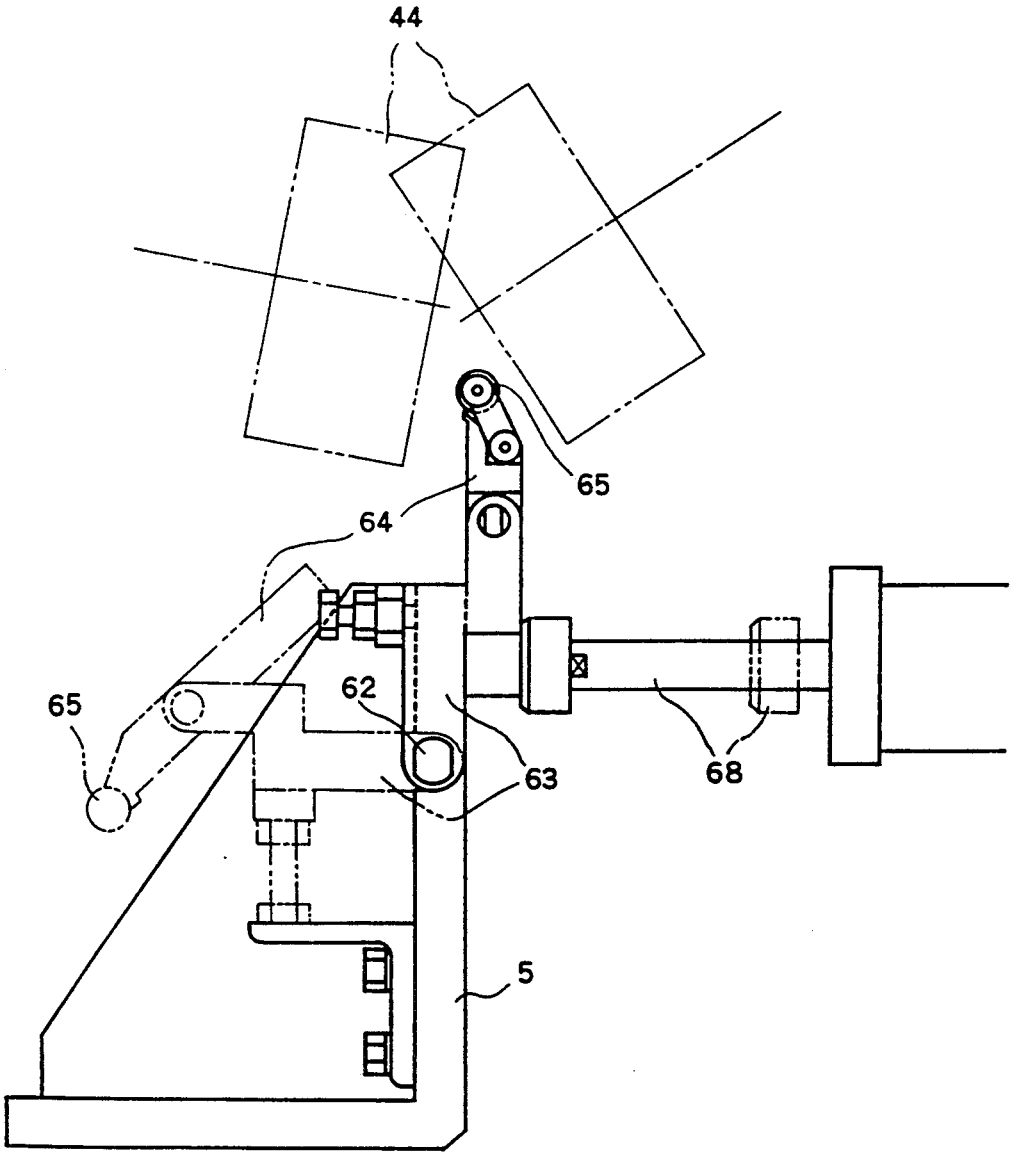
FIG. 12 is a side view illustrating part of an apparatus of a third embodiment according to the invention.
Figure 13:
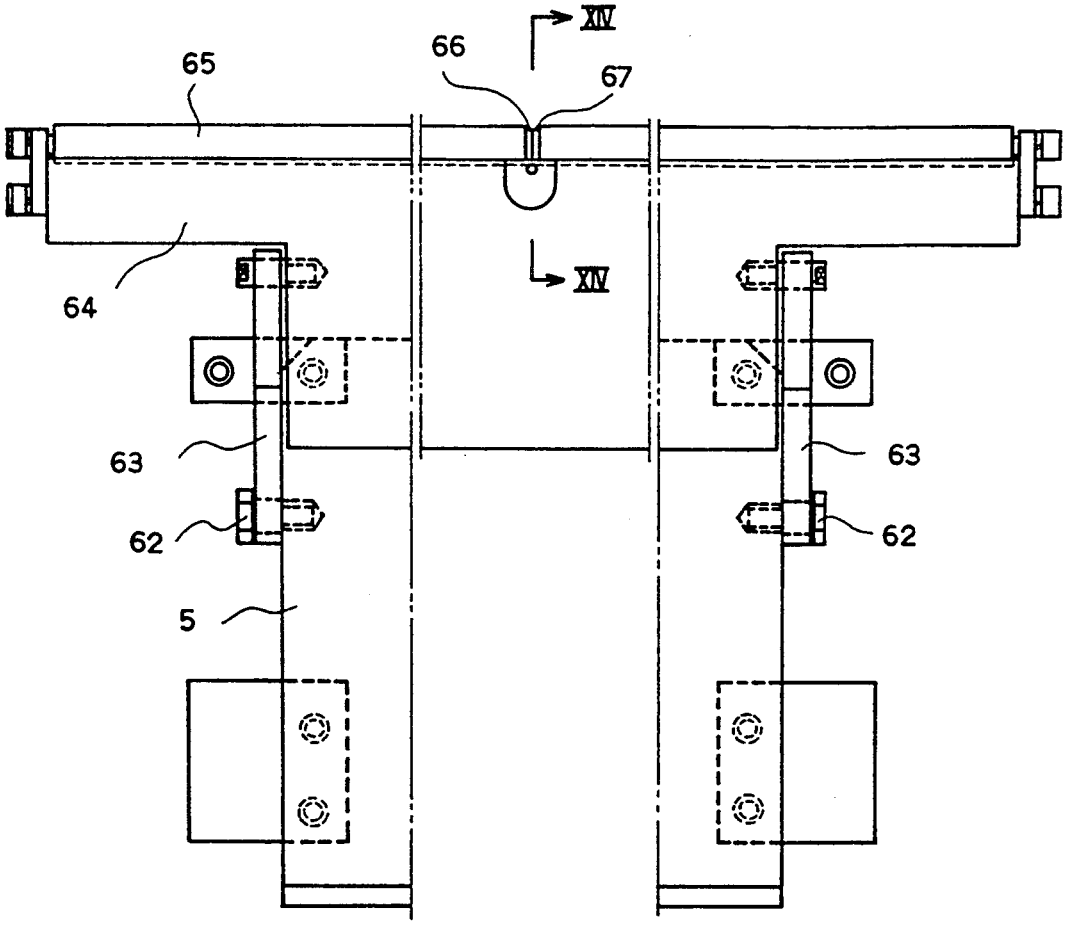
FIG. 13 is a front view showing the apparatus of FIG. 12.

A third embodiment of the invention is now described in detail according to FIGS. 12 and 13.

Since the third embodiment mostly has similar structure, operation, and effects to the first, the modified, and the second embodiments, only different points are described here.

A pair of arms 63 are pivotably supported by pin supports 62 disposed on a desired position of the longitudinal length. A support 64 is further fixed to the other ends of the arms 63. A dresser bar 65 is mounted on the support 64 rotatably and parallel to the face of the cutting tool 1. The dresser bar 65 may be a harder abrasive bar or have an outer surface of abrasive grains harder than the grinding wheel 44.

Figure 14:
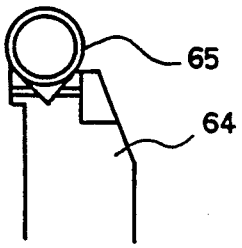
FIG. 14 is a cross sectional view taken on the line XIV—XIV of FIG. 13.

The dresser bar may be round or any polygonal in shape. The dresser bar 65 of the embodiment includes a ceramic grinding surface applied on a metal body. The dresser 65 is rotatably attached to the support 64 with screws. When a long and thin dresser bar is used, the upper portion of the support 64 is formed into V-shape or arc-shape as shown in FIG. 14 so as to extend the contact with the lower circumference of the dresser bar 65. A groove or grooves are also formed on the center or other desirable positions of the dresser bar 65 to securely fix the dresser bar 65 to the support 64 with a wire 67.

The apparatus for superfinishing the cutting edge thus constructed is operated in the following manner.

The dresser bar 65 is moved from a waiting position while the cutting tool 1 is not on the table 4. The arms 63 are rotated around the pin supports 62, and accordingly the support 64 fixed to the arms 63 is rotatingly lifted around the pin supports 62. The dresser 65 is then moved from the position of the two-dot line to that of the solid line in FIG. 12.

The support 64 is fixed to the table 4 by the fixing unit 3, which may include plural set bolts or driven by fluid pressure applied from plural fluid pressure mechanisms 68 disposed in the longitudinal direction of the upright panel 2.

The grinding wheel 44 is moved to the dresser 65 supported on the table 4 and made contact with the dresser 65 by a certain width of the grinding surface band. The grinding wheel 44 is then rotated with actuation of the prime mover 25. The driving mechanism 7 moves the carriage 6 in the longitudinal direction of the upright panel 2, and accordingly, the grinding wheel is rotatingly transferred along the longitudinal length of the dresser 65.

When a new grinding wheel 44 is polished, an outward slope with a constant angle is formed on the grinding wheel 44 and undesirable vibration is reduced. On the other hand, when a used grinding wheel 44 is polished, roughness and unevenness of the grinding surface and loading due to dust or worn abrasive grains are effectively removed.

When the dresser 65 is of a large diameter and has a relatively large dead weight, the dresser 65 is stable and not undesirably vibrated. On the other hand, when the dresser 65 is of a small diameter and long, undesirable vibration due to rotation including upper-cut rotation of the grinding wheel 44 is observed. In the latter case, the dresser 65 is securely fixed to the support 64 on the center or other plural positions, thus preventing the undesirable vibration.

Although the dresser 65 is fixed to a desired position on the table 4 via the support 64 and the arms 63 and rotatingly lifted to a position parallel to the face of the cutting tool 1 in the embodiment, it may be lifted from a position immediately below the cutting tool 1 by applying crank force, worm force, or fluid pressure to the support. Alternatively, the dresser 65 and the support may be formed as an integral unit and detachably mounted on the table 4 at a position parallel to the face of the cutting tool 1.

When the dresser 65 is fixed parallel to the cutting tool 1 on the longitudinal extension of the table 4, grinding of the cutting tool 1 and polish of the grinding wheel 44 are more efficiently performed. In this case, the carriage 6 is moved to the extension and accordingly the grinding wheel 44 is moved along the cutting tool 1 and then the dresser 65, thus preventing rough surface and loading of the grinding wheel 44 and allowing optimal and desirable grind.

Since there may be many other modifications and changes without departing from the scope of the invention, the embodiments above are not intended to limit the invention to the embodiments but are intended to illustrate the invention more clearly.

What is claimed is:

1. An apparatus for superfinishing a cutting tool having a true edge comprising:

a table for supporting the cutting tool;

a carriage movable in the longitudinal direction of the true edge of the cutting tool by a driving mechanism;

a baseplate fixed to the carriage and leaning to the table;

a transport unit mounted on the baseplate and movable to the cutting tool;

a grinding wheel rotatably supported on the transport unit via slide means comprising a sliding body and a slide guide;

pressing means engaged with the slide means for pressing the transport unit onto the cutting tool;

a grind degree controller installed in between the baseplate and the transport unit for determining a grind degree; and a braking mechanism attached to the sliding body for pressing the slide guide and thereby locking the sliding movement of the sliding body.

2. An apparatus in accordance with claim 1, further comprising: a grind angle controller for determining a grind angle against the true edge of the cutting tool; and an angle detector for detecting the determined angle.

3. An apparatus in accordance with claim 2, wherein the grind angle controller is driven by one or plural gears or screws.

4. An apparatus in accordance with claim 1, wherein the driving mechanism comprises one or plural pulleys.

5. An apparatus in accordance with claim 1, wherein the driving mechanism is driven by fluid pressure.

6. An apparatus in accordance with claim 1, wherein the grind degree controller comprises a dial indicator.

7. An apparatus in accordance with claim 1, wherein the grind degree controller comprises an encoder.

8. An apparatus in accordance with claim 1, wherein the grind degree controller comprises a linear transformer.

9. An apparatus in accordance with claim 1, wherein the braking mechanism comprises a fluid cylinder and a piston rod.

10. An apparatus in accordance with claim 1, wherein the braking mechanism comprises a screw and a servo motor.

11. An apparatus in accordance with claim 1, wherein the braking mechanism comprises an electromagnet and a plunger.

12. An apparatus in accordance with claim 1, wherein the pressing means is driven by fluid pressure.

13. An apparatus in accordance with claim 1, wherein the pressing means is driven by spring or springs.

14. An apparatus for superfinishing a cutting tool having a true edge comprising:

a table for supporting the cutting tool;

a carriage movable in the longitudinal direction of the true edge of the cutting tool by a driving mechanism;

a baseplate fixed to the carriage and leaning to the table;

a transport unit mounted on the baseplate and movable to the cutting tool;

a grinding wheel rotatably supported on the transport unit via slide means comprising a sliding body and a slide guide;

pressing means engaged with the slide means for pressing the transport unit onto the cutting tool; and a grind degree controller installed in between the baseplate and the transport unit for actuating and stopping a motor to control a grind degree;

a braking mechanism attached to the sliding body for pressing the slide guide and thereby locking the sliding movement of the sliding body;

a rail laid above and parallel to the slide means against the grinding wheel;

a movable balancer suspended from the rail; and a link support projected from the transport unit to the grinding wheel for connecting the slide means with the balancer.

15. An apparatus for superfinishing a cutting tool having a true edge comprising:

a table for supporting the cutting tool;

a carriage movable in the longitudinal direction of the true edge of the cutting tool by a driving mechanism;

a baseplate fixed to the carriage and leaning to the table;

a transport unit mounted on the baseplate and movable to the cutting tool;

a grinding wheel rotatably supported on the transport unit via slide means comprising a sliding body and a slide guide;

pressing means engaged with the slide means for pressing the transport unit onto the cutting tool; and a grind degree controller installed in between the baseplate and the transport unit for actuating and stopping a motor to control a grind degree;

a braking mechanism attached to the sliding body for pressing the slide guide and thereby locking the sliding movement of the sliding body;

a dresser bar having an outer grinding face, which is detachably mounted on a desired position of the longitudinal length of the table so as to be parallel to the true edge of the cutting tool.

16. An apparatus in accordance with claim 15, wherein the dresser bar is mounted on the longitudinal extension of the table.

17. An apparatus in accordance with claim 16, wherein the dresser bar comprises one or plural grooves to be securely fixed to the table.

* * * * *